US006612118B2

(12) United States Patent
Billman et al.

(10) Patent No.: US 6,612,118 B2
(45) Date of Patent: Sep. 2, 2003

(54) ICE MAKER CONTROL

(75) Inventors: Gregory M. Billman, Mason City, IA (US); Donald E. Wiley, Jr., Mason City, IA (US); Kyle B. Elsom, Mason City, IA (US)

(73) Assignee: IMI Cornelius Inc., Anoka, MN (US)

( * ) Notice: Subject to any disclaimer, the term of this patent is extended or adjusted under 35 U.S.C. 154(b) by 0 days.

(21) Appl. No.: 10/068,682

(22) Filed: Feb. 6, 2002

(65) Prior Publication Data

US 2003/0145608 A1 Aug. 7, 2003

(51) Int. Cl.[7] ..... F25C 1/12
(52) U.S. Cl. ..... 62/74; 62/135
(58) Field of Search ..... 62/74, 135, 233, 62/347

(56) References Cited

U.S. PATENT DOCUMENTS 5,582,018 A * 12/1996 Black et al. ..... 62/74
5,653,114 A * 8/1997 Newman et al. ..... 62/74
6,125,639 A * 10/2000 Newman et al. ..... 62/74

* cited by examiner

*Primary Examiner*—William E. Tapolcai
(74) *Attorney, Agent, or Firm*—Sten Erik Hakanson

(57) ABSTRACT

The ice maker herein works in the conventional manner wherein a refrigeration system provides for cooling of the evaporator. Water is first circulated over the evaporator as the evaporator is cooled. A temperature sensor is located in a water recirculating system and a microprocessor monitors the temperture of the circulating water. Once a predetermined non-freezing temperature is reached, for example 40 degrees Fahrenheit, water circulation is stopped. However, the compressor continues to run and cool the evaporator for a predetermined period of time to a desired lower temperature. The pump is then turned on and water again circulated over the evaporator initiating the ice making cycle. This process insures that ice adheres to the evaporator and does not prematurely slough off and/or result in the formation of slush.

2 Claims, 5 Drawing Sheets

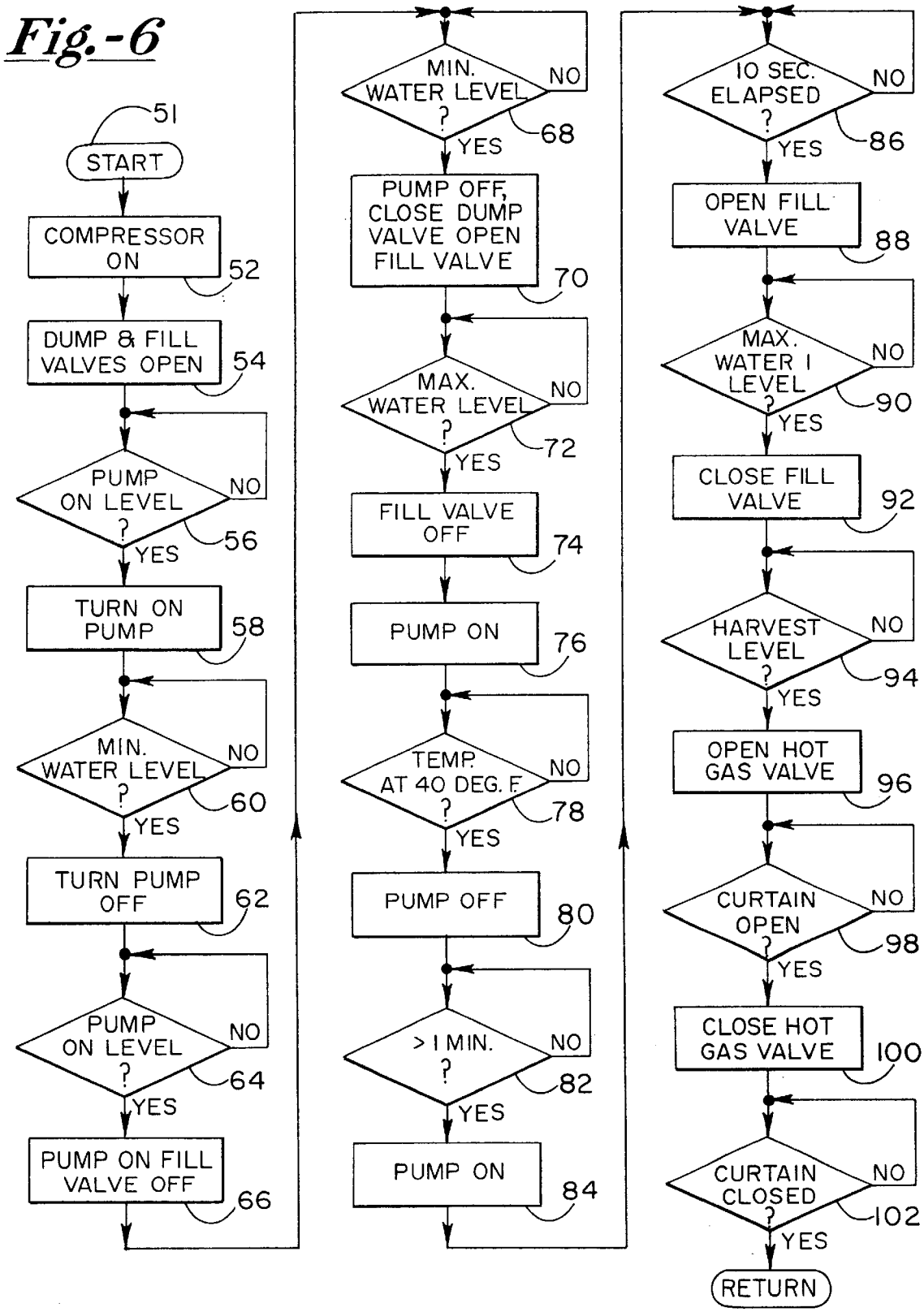
Fig.-6
START
51
COMPRESSOR ON
52
DUMP & FILL VALVES OPEN
54
PUMP ON LEVEL ?
56
NO
YES
TURN ON PUMP
58
MIN. WATER LEVEL ?
60
NO
YES
TURN PUMP OFF
62
PUMP ON LEVEL ?
64
NO
YES
PUMP ON FILL VALVE OFF
66
MIN. WATER LEVEL ?
68
NO
YES
PUMP OFF, CLOSE DUMP VALVE OPEN FILL VALVE
70
MAX. WATER LEVEL ?
72
NO
YES
FILL VALVE OFF
74
PUMP ON
76
TEMP. AT 40 DEG. F ?
78
NO
YES
PUMP OFF
80
> 1 MIN. ?
82
NO
YES
PUMP ON
84
10 SEC. ELAPSED ?
86
NO
YES
OPEN FILL VALVE
88
MAX. WATER 1 LEVEL ?
90
NO
YES
CLOSE FILL VALVE
92
HARVEST LEVEL ?
94
NO
YES
OPEN HOT GAS VALVE
96
CURTAIN OPEN ?
98
NO
YES
CLOSE HOT GAS VALVE
100
CURTAIN CLOSED ?
102
NO
YES
RETURN

ICE MAKER CONTROL

FIELD OF THE INVENTION

The present application relates generally to ice making machines, and specifically to controls and sensors as used therein.

BACKGROUND

Ice making machines are well known in the art, and typically include an ice cube making mechanism located within a housing along with an insulated ice retaining bin for holding a volume of ice cubes produced by the ice forming mechanism. In one type of ice maker a vertically oriented evaporator plate is used to form a slab of ice characterized by a plurality of individual cubes connected by ice bridges there between. As the slab falls from the evaporator plate into the ice bin, the ice bridges have a tendency to break forming smaller slab pieces and individual cubes. As is well understood, the ice slab is formed by the circulating of water over the cooled surface of the evaporator plate, the plate forming a part of a refrigeration system including a compressor and a condenser. Water that is not initially frozen to the evaporator falls into a drip pan positioned below the evaporator and is pumped there from back over the evaporator. After sufficient time has elapsed, ice of a desired thickness will form on the evaporator.

Of critical importance to ice makers of this general type, is knowing when the ice is of the desired thickness to be harvested. Once the harvest point is reached, the making of ice is discontinued by stopping the flow of water over the evaporator and the cooling thereof. The evaporator plate is then heated, typically by the use of hot gas from the refrigeration system. The ice slab then melts slightly releasing its adhesion to the plate so that it can fall into the bin positioned there below. Various controls have been proposed and used over the years to signal the harvest point.

Occasionally, however, the proper functioning of such harvest controls can be interfered with by the imperfect formation of ice on the evaporator. For example, it is known that under certain high ambient conditions, for example, ice can initially form on the evaporator that is not well adhered thereto. Such ice can prematurely fall from the evaporator prior to reaching the desired harvest point. This ice can be in the form of pieces of hard ice or can even comprise a slush. This "volunteer harvest" ice can fall into the drip pan and cause disruption of the recycling flow of the water by interfering with the operation of the pump that provides therefor, and can also block or otherwise compromise the operation of the ice harvest detection equipment. In either case, proper operation of the ice maker can be interfered with resulting in premature ice harvest, lack of harvest, damage to the ice maker and the like. Accordingly, it would be desirable to have an ice maker that prevents improper ice formation that results in premature falling thereof from the evaporator.

SUMMARY OF THE INVENTION:

The ice maker herein works in the conventional manner wherein a refrigeration system provides for cooling of the evaporator. Water is first circulated over the evaporator as the evaporator is cooled. A temperature sensor is located in the water recirculating system and a microprocessor monitors the temperture of the circulating water. Once a predetermined temperature is reached, for example 40 degrees Fahrenheit, water circulation is stopped. However, the compressor continues to run and cool the evaporator for a predetermined period of time, such as, one minute. The pump is then turned on and water again circulated over the evaporator initiating the ice making cycle.

Those of skill will appreciate that the first cycling of the water permits the cooling thereof to a relatively cold temperature, but above freezing so that ice is not formed on the evaporator. After the first water circulating is stopped the evaporator is permitted to cool down to a temperature at which it is ready to form ice. Therefore, the control of the present invention insures that the water and the evaporator are both at sufficiently low temperatures such that initiation of ice formation will result in strong adherence of ice to the evaporator. As a result thereof, "slushing" or the formation of otherwise poorly adhered ice, is prevented.

DESCRIPTION OF THE DRAWINGS

A better understanding of the structure, function, operation and advantages of the present invention can be had by referring to the following detailed description which refers to the following drawing figures, wherein:

FIG. 6 shows a flow diagram of the control strategy of the present invention.

DETAILED DESCRIPTION OF THE PREFERRED EMBODIMENT

Figure 1:
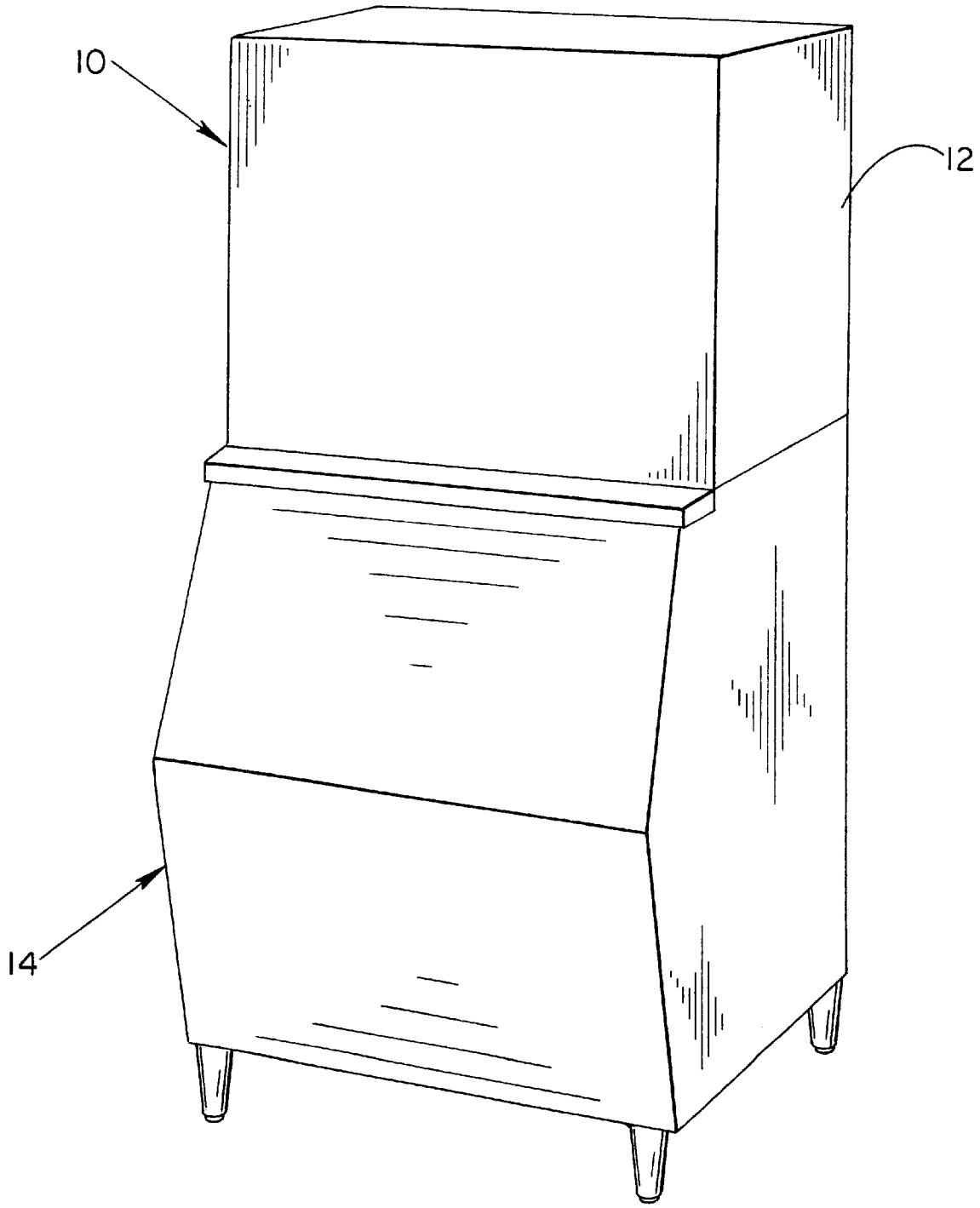
FIG. 1 shows a perspective view of an ice maker mounted atop an ice storage bin.

The ice maker of the present invention is seen in FIG. 1, and referred to generally by the numeral 10. Ice maker 10 includes an exterior housing 12 and is positioned atop an insulated ice retaining bin 14. As is further understood by referring to FIGS. 2 and 3, and as is conventional in the art, ice maker 10 includes a vertical ice forming evaporator plate 16, a condenser and fan 18 and a compressor 20 connected by high pressure refrigerant lines 21*a* and low pressure line 21*b*. As is also well understood, the refrigeration system herein includes an expansion valve 22 and a hot gas valve 24. A water catching pan 26 is positioned below evaporator 16 and includes a partial cover 27. A water distribution tube 28 having a water inlet 29 extends along and above evaporator 16. A water supply solenoid valve 30 has an inlet connected to a source of potable water, not shown, and an outlet line 31 supplying water to pan 26. A water pump 32 provides for circulating water from outlet 32*b* thereof to inlet 29 of distribution tube 28 along a water line 34. A solenoid operated dump valve 36 is fluidly connected to line 34 and serves, when open, to direct water pumped thereto to a drain, not shown. An evaporator curtain 37 is pivotally positioned closely adjacent evaporator 16 and includes a magnetic switch 38 for indication when it has moved away from evaporator 16 to an open position indicated by the dashed line representation thereof. For purposes of clarity of the view of FIG. 2, the various fluid connections of pump 32, dump valve36 and water supply valve 30 are not shown, such being represented in schematic form in FIG. 3.

Figure 2:
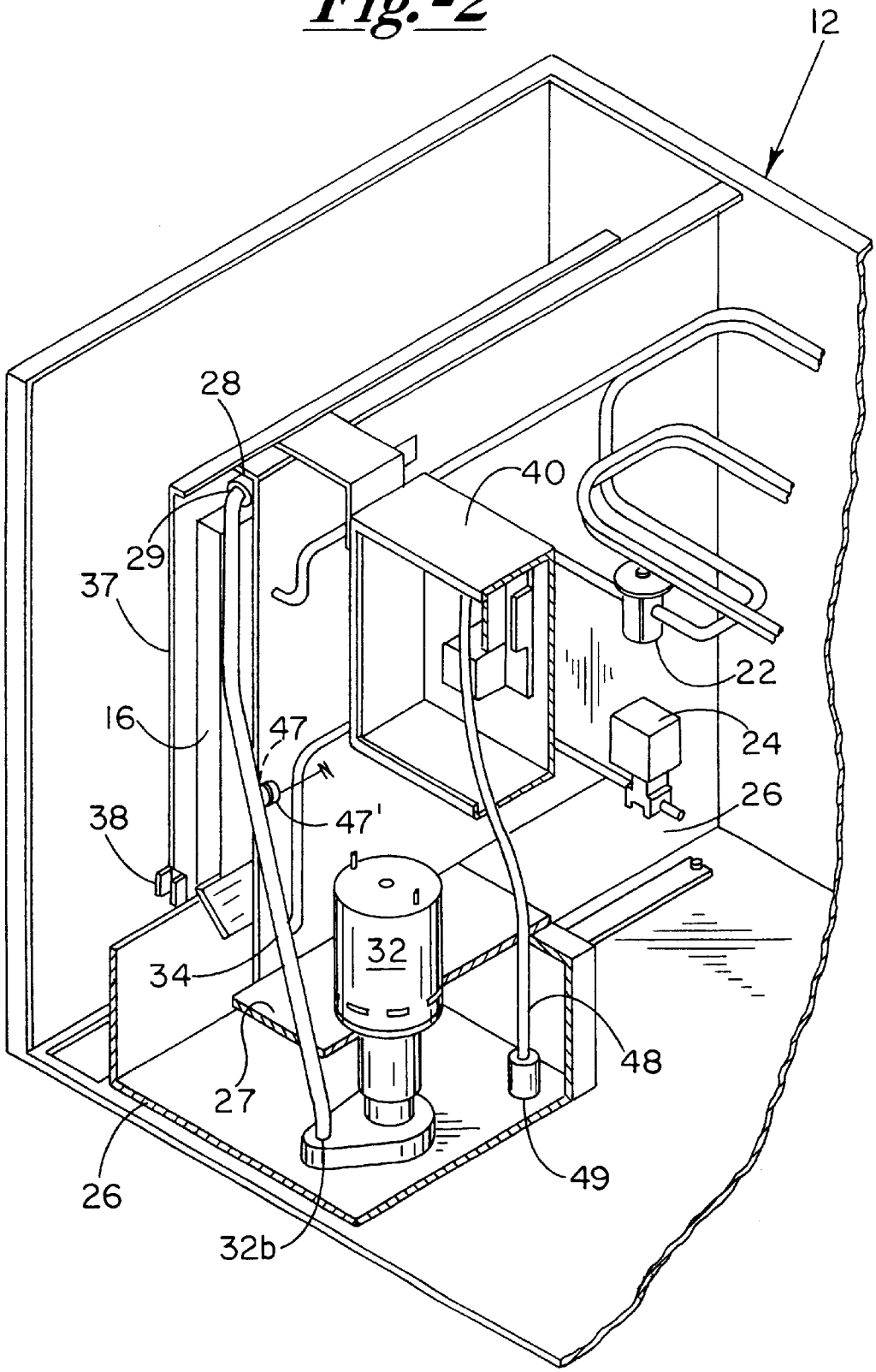
FIG. 2 shows a partial cross-sectional view of the interior of the ice maker.
Figure 3:
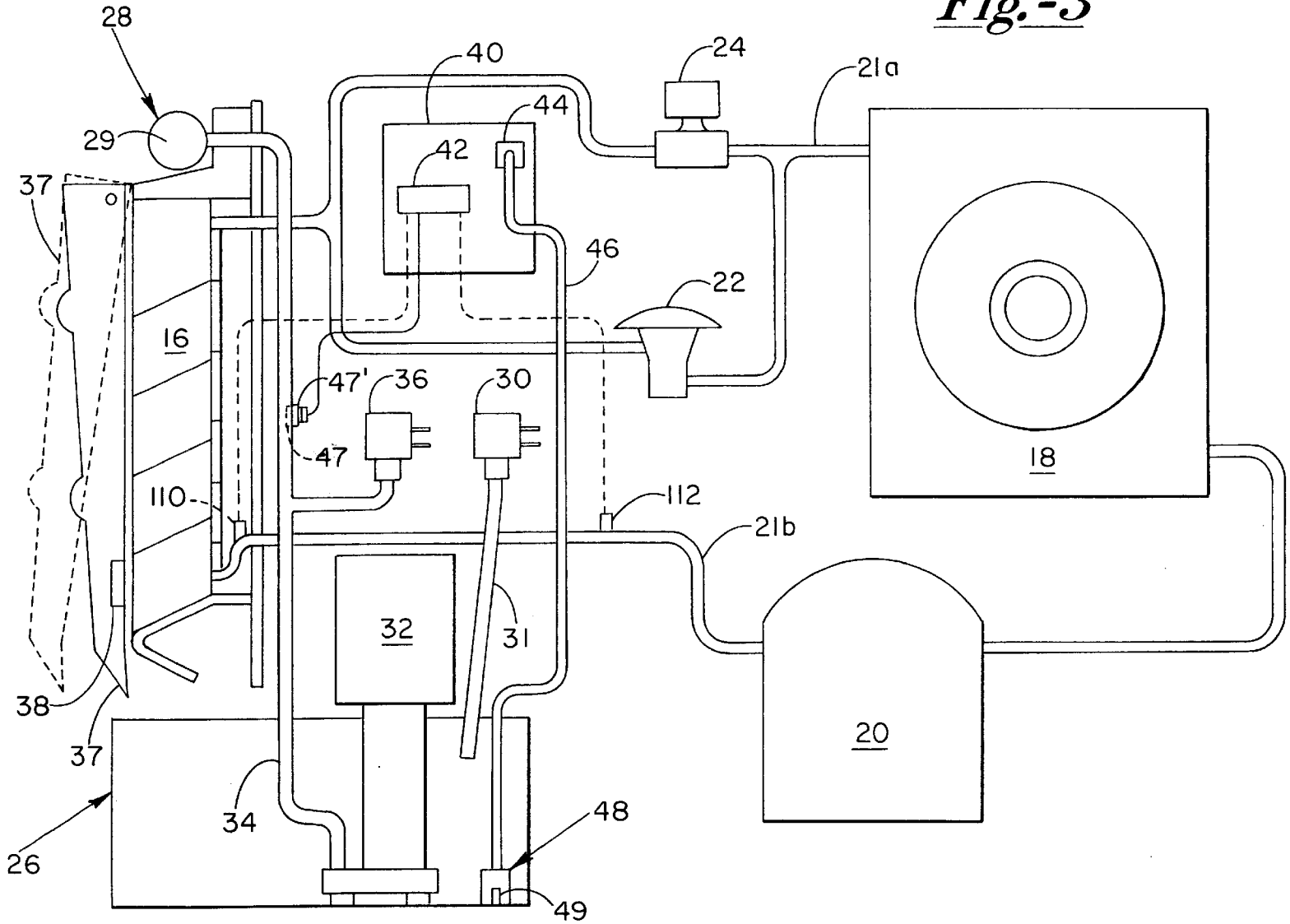
FIG. 3 shows a schematic representation of the ice maker.
Figure 4:
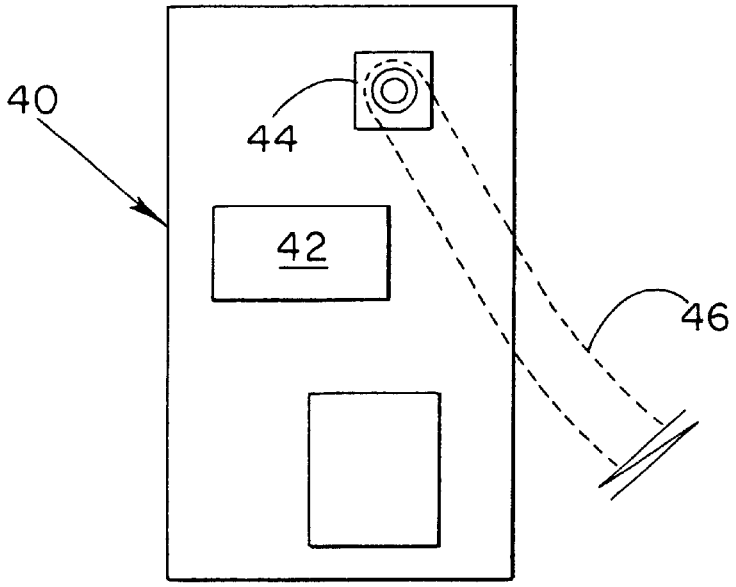
FIG. 4 shows an enlarged view of the ice maker control board.

As particularly seen in FIG. 4, and also by referring to FIG. 2, an electronic control board 40 is located within a separate housing 41 at a position remote and physically isolated from pan 26 and evaporator 16. Control board 40 includes a microprocessor 42 for controlling the operation of ice maker 10. Board 40 includes a pressure sensor 44, such as manufactured and sold by Motorola, Inc. of Phoenix, Ariz., and identified as model MPXV5004G. As understood by also viewing FIG. 5, a plastic pneumatic tube 46, shown in dashed outline, is connected to sensor 44 and on its opposite end to a cylindrical air cup or fitting 48. Those of skill will understand that housing 41 includes a cover, not shown, that provides for the enclosing and protection of control 40 and sensor 44 therein and through which tube 46 passes prior to connecting to sensor 44.

A temperature sensor 47, as for example manufactured by Advanced Thermal Products, Inc., St. Marys, Pa., and identified as an NTC thermistor, is fluid tightly secured in water circulating tube 34. Specifically, tube 34 has a T-fitting portion into which sensor 47 is tightly inserted. A clamp 47' is secured around the perimeter of the "T" portion of tube 34 thereby providing for fluid tight securing of sensor 47 therein. Sensor 47 is electrically connected to microprocessor 42 of control board 40.

A Fitting 48 resides in pan 26 at the bottom thereof and is press fit within a circular ridge 49 that is formed as an integral molded portion of the bottom surface of pan 26. Fitting 48 includes an outer housing 48*a* defining an inner air trapping area 48*b* and a tube connecting portion 48*c*. Four water flow openings 50 exist around a bottom perimeter of housing 48*a*.

Figure 5:
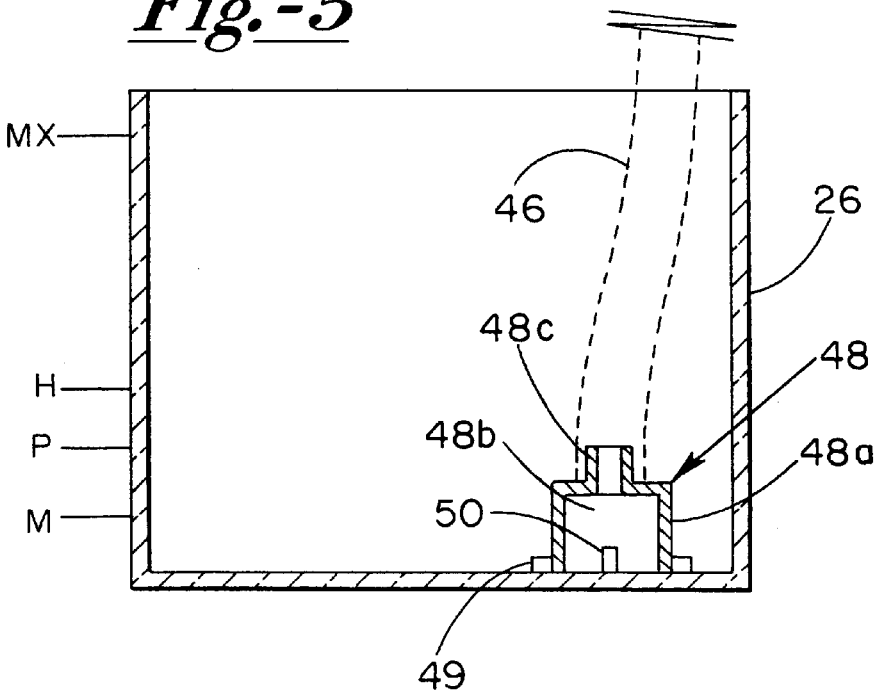
FIG. 5 shows an enlarged partial cross-sectional view of the water pan and pressure fitting.

The operation of the present invention can be better understood by referring to the flow diagram of FIGS. 6A and 6B wherein the basic operation of the present invention is shown. At start block 51 power is provided to control 40. At block 52 compressor 20 is turned on and substantially simultaneously at block 54 fill valve 30 and dump valve 36 are opened. Thus, cooling of evaporator 18 begins and water flows into pan 26. At decision block 56, once a predetermined pump-on water level is reached in pan 26, as indicated by the level line represented by the letter P in FIG. 5, circulatory water pump 32 is turned on at block 58. The pump-on point is sensed by sensor 44. In particular, as water fills pan 26, water flows through holes 50 of fitting 48. As that occurs, air trapped in area 48*b* is slightly compressed and forced into tube 46 which communicates such pressure increase to sensor 44. That pressure is then input as a voltage to microprocessor 42 which assigns a numerical value thereto corresponding to a pressure scale. Therefore, when the predetermined pressure value is sensed that corresponds to the pressure at level P, pump 32 is turned on. Because of the fluid connections of pump 32 and dump valve 36, the action of pump 32 serves to move any water in pan 26 to valve 36 causing the draining away thereof. Thus, a minimum water level, indicated by the level line represented by the letter M in FIG. 5, is sensed in the same manner as described above for level P. When that predetermined volume of the water has been removed from pan 26, pump 32 is stopped at block 62. As the water supply valve remains on, the level in pan 26 begins to rise and when the P level is again sensed at block 64, then at block 66, pump 32 is re-started and fill valve 30 closed. As dump valve 34 remains open, water will again be pumped from pan 26. At block 68 control 40 again senses for the attainment of the M level. When that occurs, then, at block 70, water pump 32 is stopped, dump valve 34 is closed and fill valve 30 is opened. It can be appreciated that blocks 52–68 serve as a dump cycle whereby any contaminants that have accumulated in pan 26 are agitated by the action of pump 32 and the inflow of water and are twice flushed in this manner and removed from the system.

At block 72 control 40 monitors for the attainment of a maximum fill level for pan 26 indicated by the level line denoted by letters MX. When this highest pressure level is sensed, then at block 74 fill valve 30 is closed. At block 76, the pump is turned on and the water is again circulated over evaporator 16. Temperature sensor 47 monitors the temperature of the circulating water at block 78 and when that temperature reaches 40 degrees Fahrenheit, the pump, at block 80, is turned off. At decision block 82 a period of time, such as one minute is allowed to time out. It will be understood that during this time the evaporator is allowed to further cool down as the compressor is continuing to run. At block 84, the circulating pump is turned back on and the water again flows over the evaporator. A ten second clock is set at block 86, and when that has timed out, fill valve 30 is opened. at block 88. It will be understood by those of skill that action of pump 32 will serve to fill fluid line 34 and distribution tube 28 which will slightly lower the level of water in pan 26 below that of the desired maximum water volume indicated by level MX. Thus, fill valve 30 is opened at block 88, to replenish that volume as is determined at block 90. At block 92, fill valve 30 is closed when the desired starting maximum level MX is again attained.

At this point pump 32 is operating to flow water over evaporator 16 as such is being cooled by the action of compressor 20, condenser and fan 18 and expansion valve 22, all as operated by control 40. As ice forms on evaporator 16, the water level in pan 26 goes down as does the pressure sensed by sensor 44. When a predetermined harvest water level is reached, as indicated by the level line denoted H, a corresponding predetermined pressure value is sensed by control 40 at block 94. When the harvest point is indicated, pump 32 is stopped and hot gas valve 24 is opened at block 96, causing evaporator 16 to warm resulting in the release of the ice slab formed thereon. Of course, those of skill will understand that other heating means known in the art could be employed, such as, an electrical heater integral with the ice forming evaporator. As is well understood, when the slab of ice falls from evaporator 16, curtain 37 is opened and switch 38 is closed, signalling to the control 40, at block 98, the release of the ice slab from evaporator 16, i.e. that the curtain is open. The hot gas valve is then closed at block 100. As is also known, to insure that the slab of ice has fallen into bin 12 and is no longer in the vicinity of evaporator 16, at block 96, the control herein awaits the remaking of switch 38, block 102, which occurs when curtain 36 is free to swing back to its normal closed position unobstructed by any ice. At block 104 the control returns to start and initiates a further ice making cycle.

Those of skill will appreciate that the above control process is described in the context of the operation of a particular ice making machine. However, the essential steps of the control method of the present invention require that a volume of water be circulated over the evaporator while the evaporator is being cooled in order to pre-cool the water to a predetermined non-freezing point. In other words, the object during the pre-cool is not to form any ice. This pre-cooling is accomplished by the use of a temperature sensor that tracks the temperature of the circulated water and signals when the predetermined non-freezing temperature is reached. The circulation of the water is then stopped, but the cooling of the evaporator is continued in order to pull the temperature thereof down to a colder temperature. After the evaporator has a chance to cool further, the ice making cycle is then initiated by re-starting the circulation of the precooled water. Those of skill will appreciate that the above described process insures that both the circulating water and the evaporator are both sufficiently cold such that at the initiation of the ice making cycle the first ice to be formed will be securely held to the evaporator. Thus, "slushing" or other undesired formation of ice that prematurely falls from the evaporator, is prevented.

Naturally, the temperature to which the volume of water is first cooled and the period of time that the circulation of the water is subsequently turned off while the evaporator is allowed to cool without the water circulating over it, are matters of design choice for those of skill in the art based on such variables as size and type of refrigeration components, typical ambient conditions, volume of ice made per cycle, etc. In the embodiment described herein, it was found sufficient to bring the evaporator down to a temperature of approximately seven degrees Fahrenheit. In the preferred embodiment of the present invention, a period of time was experimentally determined that will be sufficient in most all conditions to assure that the evaporator is brought to that desired low initiating of ice making temperature of 7 degrees Fahrenheit. In a further embodiment, either a temperature sensor 110 located at the outlet of evaporator 16 or a pressure sensor 112 along the suction line 21*b* of compressor 20, both being connected to control 42, can be used to directly sense, or determine by correlation to temperature and pressure, respectively, when the evaporator is at the desired initiating of ice making temperature. Of course, use of either of sensors 110 or 112 add cost, although do provide for more accuracy. It will be understood by those of skill that directly sensing or determining the evaporator temperature permits a modification of the previously described method of the present invention. In particular, after the volume of water is brought to the desired non-freezing temperature and the circulation of that water is stopped, the cooling of the evaporator is continued until the evaporator is determined to be at the desired initiating of ice making temperature, after which circulation of the water is re-initiated. In this manner an average period of time is not selected that assumes that the evaporator is at that desired temperature, rather that temperature is determined directly.

What is claimed is:

1. A method for controlling an ice maker, the ice maker having a refrigeration system for providing cooling of an ice forming evaporator, and a water circulatory system for circulating water over the evaporator for forming ice thereon as the evaporator is cooled by the refrigeration system, the method comprising the steps of:

circulating a volume of water over the evaporator while cooling the evaporator and while sensing the temperature of the circulated volume of water, stopping the circulating of the volume of water when a predetermined nonfreezing temperature of the water is sensed, continuing to cool the evaporator after the stopping of the circulating of the volume of water for a period of time to permit further cooling of the evaporator, re-starting circulating of the volume of water over the evaporator for initiating an ice making cycle.

2. A method for controlling an ice maker, the ice maker having a refrigeration system for providing cooling of an ice forming evaporator, and a water circulatory system for circulating water over the evaporator for forming ice thereon as the evaporator is cooled by the refrigeration system, the method comprising the steps of:

circulating a volume of water over the evaporator while cooling the evaporator and while sensing the temperature of the circulated volume of water, stopping the circulating of the water when a predetermined nonfreezing temperature of the volume of water is sensed, continuing to cool the evaporator after the stopping of the circulating of the volume of water while sensing the temperature of the evaporator and re-starting circulating of the volume of water over the evaporator for initiating an ice making cycle when a predetermined initiating of ice making temperature of the evaporator is sensed.

* * * * *